US006531274B1

(12) United States Patent
Mydlarz et al.

(10) Patent No.: US 6,531,274 B1
(45) Date of Patent: Mar. 11, 2003

(54) HIGH CHLORIDE EMULSION DOPED WITH COMBINATION OF METAL COMPLEXES

(75) Inventors: Jerzy Z. Mydlarz, Fairport, NY (US); Woodrow G. McDugle, Rochester, NY (US); Raymond S. Eachus, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/919,514

(22) Filed: Jul. 31, 2001

(51) Int. Cl.[7] ..... G03C 1/005; G03C 1/494

(52) U.S. Cl. ..... 430/567; 430/599; 430/604; 430/605; 430/569; 430/363

(58) Field of Search ..... 430/567, 599, 430/604, 605, 363, 569

(56) References Cited

U.S. PATENT DOCUMENTS

| | | | | |
|---|---|---|---|---|
| 4,933,272 | A | 6/1990 | McDugle et al. | |
| 4,945,035 | A | 7/1990 | Keevert, Jr. et al. | |
| 5,320,938 | A * | 6/1994 | House et al. | 430/567 |
| 5,360,712 | A | 11/1994 | Olm et al. | |
| 5,457,021 | A | 10/1995 | Olm et al. | |
| 5,462,849 | A | 10/1995 | Kuromoto et al. | |
| 5,470,771 | A | 11/1995 | Fujii et al. | |
| 5,474,888 | A | 12/1995 | Bell | |
| 5,494,789 | A | 2/1996 | Daubendiek et al. | |
| 5,500,335 | A | 3/1996 | Bell | |
| 5,503,970 | A | 4/1996 | Olm et al. | |
| 5,503,971 | A | 4/1996 | Daubendiek et al. | |
| 5,597,686 | A | 1/1997 | MacIntyre et al. | |
| 5,783,373 | A | 7/1998 | Mydlarz et al. | |
| 5,783,378 | A | 7/1998 | Mydlarz et al. | |
| 5,830,631 | A | 11/1998 | Hendricks et al. | |
| 6,017,684 | A | 1/2000 | Miyake | |
| 6,107,018 | A | 8/2000 | Mydlarz et al. | |
| 6,159,679 | A | 12/2000 | Vandenbroucke | |
| 6,162,599 | A | 12/2000 | Vandenbroucke et al. | |
| 6,242,172 | B1 | 6/2001 | Budz et al. | |
| 6,284,450 | B1 * | 9/2001 | Vandenbroucke et al. | 430/605 |
| 6,322,960 | B1 * | 11/2001 | Murakami et al. | 430/604 |

FOREIGN PATENT DOCUMENTS

| | | |
|---|---|---|
| EP | 800 109 | 10/1998 |
| EP | 1 033 616 | 9/2000 |

OTHER PUBLICATIONS

Abstract for JP 5142712, published Jun. 11, 1993, titled "Image Forming Method", of Fuji Photo Film.

* cited by examiner

*Primary Examiner*—Geraldine Letscher
(74) *Attorney, Agent, or Firm*—Andrew J. Anderson

(57) ABSTRACT

A radiation-sensitive emulsion comprised of silver halide grains (a) containing greater than 50 mole percent chloride, based on silver, (b) having greater than 50 percent of their surface area provided by {100} crystal faces, and (c) having a central portion accounting for up to 99 percent of total silver and containing a first dopant of Formula (I) and a second dopant of Formula (II):

$$[RuL_6]^n \quad (I)$$

wherein n is zero, −1, −2, −3 or −4, and $L_6$ represents bridging ligands which can be independently selected, provided that at least four of the ligands are anionic ligands, and at least one of the ligands is a cyano ligand or a ligand more electronegative than a cyano ligand;

$$[TE_4(NZ)E']^r \quad (II)$$

wherein T is Os or Ru; $E_4$ represents bridging ligands which can be independently selected; E' is E or NZ; r is zero, −1, −2 or −3; and Z is oxygen or sulfur; wherein the dopant of Formula (II) is selected from hexacoordination complexes which form deep electron traps in silver chloride grains by providing an incorporated molecular entity having a lowest unoccupied molecular orbital which is at least 0.5 eV below the conduction band of the silver chloride grains, where (i) less than 60% of the deep electron traps empty within 2000 seconds at 300 K after being filled and (ii) between 15–60% of the deep electron traps empty within 12,000 seconds at 300 K after being filled. Improved latent image keeping performance can be obtained for optical and digital exposed elements which comprise silver halide grains in an emulsion layer doped with a dopant of Formula (I) and a dopant of Formula (II) as described above, while substantially maintaining other desired photographic parameters.

21 Claims, No Drawings

HIGH CHLORIDE EMULSION DOPED WITH COMBINATION OF METAL COMPLEXES

FIELD OF THE INVENTION

This invention is directed to radiation sensitive silver halide emulsions useful in photography, including electronic printing methods wherein information is recorded in a pixel-by-pixel mode in a radiation silver halide emulsion layer, comprising a combination of specified classes of dopants.

DEFINITION OF TERMS

The term "high chloride" in referring to silver halide grains and emulsions indicates that chloride is present in a concentration of greater than 50 mole percent, based on total silver.

In referring to grains and emulsions containing two or more halides, the halides are named in order of ascending concentrations.

All references to the periodic table of elements periods and groups in discussing elements are based on the Periodic Table of Elements as adopted by the American Chemical Society and published in the *Chemical and Engineering News,* Feb. 4, 1985, p. 26. The term "Group VIII" is used to generically describe elements in groups 8, 9 and 10.

The term "cubic grain" is employed to indicate a grain is that bounded by six {100} crystal faces. Typically the corners and edges of the grains show some rounding due to ripening, but no identifiable crystal faces other than the six {100} crystal faces. The six {100} crystal faces form three pairs of parallel {100} crystal faces that are equidistantly spaced.

The term "cubical grain" is employed to indicate grains that are at least in part bounded by {100} crystal faces satisfying the relative orientation and spacing of cubic grains. That is, three pairs of parallel {100} crystal faces are equidistantly spaced. Cubical grains include both cubic grains and grains that have one or more additional identifiable crystal faces. For example, tetradecahedral grains having six {100} and eight {111} crystal faces are a common form of cubical grains.

The term "tabular grain" indicates a grain having two parallel major crystal faces (face which are clearly larger than any remaining crystal face) and having an aspect ratio of at least 2.

The term "aspect ratio" designates the ratio of the equivalent circular diameter of a major face to grain thickness.

The term "tabular grain emulsion" refers to an emulsion in which tabular grains account for greater than 50 percent of total grain projected area.

The term "{100} tabular" is employed in referring to tabular grains and tabular grain emulsions in which the tabular grains have {100} major faces.

The term "central portion" in referring to silver halide grains refers to that portion of the grain structure that is first precipitated accounting for up to 99 percent of total precipitated silver required to form the grains.

The term "dopant" is employed to indicate any material within the rock salt face centered cubic crystal lattice structure of a silver halide grain other than silver ion or halide ion.

The term "dopant band" is employed to indicate the portion of the grain formed during the time that dopant was introduced to the grain during precipitation process.

The term "surface modifier" refers to any material other than silver ion or halide ion that is associated with a portion of the silver halide grains other than the central portion.

The term "log E" is the logarithm of exposure in lux-seconds.

Speed is reported as relative log speed, where 1.0 relative log speed units is equal to 0.01 log E.

The term "contrast" or "$\gamma$" is employed to indicate the slope of a line drawn from stated density points on the characteristic curve.

The term "reciprocity law failure" refers to the variation in response of an emulsion to a fixed light exposure due to variation in the specific exposure time.

*Research Disclosure* is published by Kenneth Mason Publications, Ltd., Dudley House, 12 North St., Emsworth, Hampshire P010 7DQ, England.

BACKGROUND

In its most commonly practiced form silver halide photography employs a film in a camera to produce, following photographic processing, a negative image on a transparent film support. A positive image for viewing is produced by exposing a photographic print element containing one or more silver halide emulsion layers coated on a reflective white support through the negative image in the camera film, followed by photographic processing. Whereas high bromide silver halide emulsions are the overwhelming commercial choice for camera films, high chloride grain emulsions are the overwhelming commercial choice for photographic print elements. In a relatively recent variation negative image information is retrieved by scanning and stored in digital form. The digital image information is later used to expose imagewise the emulsion layer or layers of the photographic print element. Whether a conventional optical or a digital image printing exposure is employed, it is desired in high chloride emulsions for color paper applications to obtain high photographic speed at the desired sensitometric curve shape.

A typical example of imaging systems which require that a hard copy be provided from an image which is in digital form is electronic printing of photographic images which involves control of individual pixel exposure. Such a system provides greater flexibility and the opportunity for improved print quality in comparison to optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration exposure in a pixel-by-pixel mode using a suitable source, such as a light emitting diode (LED) or laser. A cathode ray tube (CRT) is also sometimes used as a printer light source in some devices. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, *The Reproduction of Colour,* Fourth Edition, pages 306–307, (1987). Budz et al U.S. Pat. No. 5,451,490 discloses an improved electronic printing method which comprises subjecting a radiation sensitive silver halide emulsion layer of a recording element to actinic radiation of at least $10^{-4}$ ergs/cm$^2$ for up to 100 $\mu$seconds duration in a pixel-by-pixel mode. The radiation sensitive silver halide emulsion layer contains a silver halide grain population comprising at least 50 mole percent chloride, based on silver, forming the grain population projected area. At least 50 percent of the grain population projected area is accounted for by tabular grains that are bounded by {100} major faces having adjacent edge ratios of less than 10, each having an aspect ratio of at least 2. The substitution of a high chloride tabular grain emulsion for a high chloride cubic grain emulsion was demonstrated to reduce high intensity reciprocity failure (HIRF).

Electronic digital printing onto silver halide media frequently is subject to the appearance of various digital printing artifacts. Image artifacts which may be associated with optical scan printing on silver halide media include "digital fringing", "contouring", and "banding". Of the artifacts associated with printing digital images onto silver halide media, "digital fringing", or the formation of visually soft edges, especially around text, probably elicits the greatest objections. This artifact pertains to unwanted density formed in an area of a digital print as a result of a scanning exposure in a different area of the print. Digital fringing may be detected in pixels many lines away from area(s) of higher exposure, creating an underlying minimum density or Dmin that reduces sharpness and degrades color reproduction. "Contouring" refers to the formation of discrete density steps in highlight regions where the gradations should appear continuous. Bit limited system modulators (those that use >=210 bits, or 1024 DAC levels, designated 10 bit), e.g., may have too few levels to calibrate for density differences that are below the detection threshold of the human eye. A single bit change in exposure may, therefore, produce a density change large enough to see as a step, or contour. "Banding" is the appearance of lines, or bands, having a lower frequency than the individual raster lines, but which are parallel to the line scan direction. The bands arise from non-uniformity in the overlap exposure between scans (e.g., from mechanical vibrations) causing fluctuations in exposure in the overlap areas large enough to produce a visually detectable difference in density.

One of the most important parameters describing suitability of color paper for digital exposure is "dynamic range", which may be defined as the amount of energy that has to be delivered to an emulsion to reach the desired printing density. For most digital printing devices the dynamic range should be equal to about 1 log E. Too wide dynamic range may result in the appearance of digital fringing in a color paper. The minimum exposure at which digital fringing becomes visually objectionable varies by digital printing device and emulsion photographic properties. Because fringing increases with exposure, the useful density range for typical commercial color photographic papers printed by scanning laser or LED (light emitting diode) exposures must be restricted to 2.2 or below, less than the full density range of the papers. Fine line images require even lower print densities due to the acute sensitivity of the eye to softening of high contrast edges.

Proper design of the paper's D-log E "characteristic curve" (see, e.g., T. H. James, *The Theory of the Photographic Process,* 4$^{th}$ Ed., Macmillan, 1977, Pp. 501–504) can help minimize the occurrence of digital artifacts. In order to reduce digital fringing, e.g., a relatively high contrast is desired in the shoulder area of the characteristic curve to enable a desired dynamic range. A relatively soft toe is also desired in the characteristic curve, however, to reduce the occurrence of banding and contouring. Lower contrast toe regions of the paper characteristic curves can alleviate contouring in a 10 bit system, e.g., as taught by Kawai, Kokai JP 05/142712-A, but the low contrast also lowers the density threshold for digital fringing.

The use of dopants in silver halide grains to modify photographic performance is well know in the photographic art, as generally illustrated, e.g., by *Research Disclosure,* Item 38957, I. Emulsion grains and their preparation, D. Grain modifying conditions and adjustments, paragraphs (3)–(5). Photographic performance attributes known to be affected by dopants include sensitivity, reciprocity failure, and contrast. The features of high contrast in the shoulder area and relatively soft toe contrast desired for digital printing can be obtained for color paper photographic emulsions through selection of appropriate contrast and speed enhancing dopants.

Using empirical techniques the art has over the years identified many dopants capable of increasing photographic speed. Keevert et al U.S. Pat. No. 4,945,035, e.g., was the first to teach the incorporation of a hexacoordination complex containing a transition metal and cyano ligands as a dopant in high chloride grains to provide increased sensitivity. Scientific investigations have gradually established that one general class of such speed increasing dopants share the capability of providing shallow electron trapping sites. Olm et al U.S. Pat. No. 5,503,970 and Daubendiek et al U.S. Pat. Nos. 5,494,789 and 5,503,971, here incorporated by reference, as well as *Research Disclosure,* Vol. 367, November 1994, Item 36736, were the first to set out comprehensive criteria for a dopant to have the capability of providing shallow electron trapping sites.

The contrast of photographic elements containing silver halide emulsions can generally be increased by incorporating into the silver halide grains a dopant capable of creating deep electron trapping sites, such as illustrated by R. S. Eachus, R. E. Graves and M. T. Olm *J. Chem. Phys.,* Vol. 69, pp. 4580–7 (1978) and *Physica Status Solidi A,* Vol. 57, 429–37 (1980) and R. S. Eachus and M. T. Olm *Annu. Rep. Prog. Chem. Sect. C. Phys. Chem.,* Vol. 83, 3, pp. 3–48 (1986). Dopants may be generally characterized as creating deep electron traps in a silver halide grain crystal lattice if the following two conditions are fulfilled: the LUMO of the incorporated molecular entity should be at least 0.5 eV below the conduction band of the silver halide grain crystal, and the trapping life-time at room temperature should be higher than 0.2 seconds (see R. S. Eachus, M. T. Olm, *Cryst.Latt.Def.and Amorph.Mat.,*1989(18)297–313). The LUMO is defined as the lowest unoccupied molecular orbital of the related complex which can trap an electron from the conduction band (see D. F. Shriver, P. W. Atkins, C. H. Langford in *Inorganic Chemistry,* Oxford Univ. Press (1990), Oxford-Melbourne-Tokyo).

The use of a hexacoordination complex dopant comprising a transition metal and a nitrosyl or thionitrosyl ligand has been found to be particularly effective at increasing contrast of photographic elements, as disclosed in McDugle et al. U.S. Pat. No. 4,933,272. MacIntyre et al. U.S. Pat. No. 5,597,686 discloses that a combination of an osmium-based transition metal complex containing a nitrosyl or thionitrosyl ligand and a Group 8 transition metal complex containing cyano ligands can result in further improved contrast. U.S. Pat. Nos. 5,783,373 and 5,783,378 discuss use of combinations of transition metal complex dopants containing a nitrosyl or thionitrosyl ligand with shallow electron trapping dopants (and further with iridium coordination complex dopants for reciprocity performance) for high chloride emulsions in order to provide increased contrast in a photographic print material specifically for use in digital imaging.

While the use of deep electron trapping transition metal complex dopants containing a nitrosyl or thionitrosyl ligand in combination with shallow electron trapping dopants in high chloride emulsions has been found to enable desirable characteristic curve shapes for digital printing of color photographic paper elements, it has been found that combinations of some of such dopants can also result in latent image keeping instability problems. Latent image keeping (LIK) instability refers to a highly undesirable property of changing photographic performance as a function of the time that elapses between exposure and processing. LIK change may be seen as either a loss in speed or density or a gain in speed or density. LIK instability is particularly a problem with codoping of emulsion grains with ruthenium based shallow electron trapping dopants, which in addition to increasing photographic speed also have been found to provide advantageous reduction in heat sensitivity for spectrally sensitized emulsions, and certain deep electron trapping dopants which contain a nitrosyl or thionitrosyl ligand. It would be desirable to provide a photographic element employing a combination of ruthenium based shallow electron trapping dopants and contrast improving deep electron trapping dopants in silver halide emulsions with improved latent image keeping performance.

SUMMARY OF THE INVENTION

In one aspect this invention is directed towards a radiation-sensitive emulsion comprised of silver halide grains (a) containing greater than 50 mole percent chloride, based on silver, (b) having greater than 50 percent of their surface area provided by {100} crystal faces, and (c) having a central portion accounting for up to 99 percent of total silver and containing a first dopant of Formula (I) and a second dopant of Formula (II):

$$[RuL_6]^n \quad (I)$$

wherein n is zero, −1, −2, −3 or −4, and $L_6$ represents bridging ligands which can be independently selected, provided that at least four of the ligands are anionic ligands, and at least one of the ligands is a cyano ligand or a ligand more electronegative than a cyano ligand;

$$[TE_4(NZ)E']^r \quad (II)$$

wherein

T is Os or Ru, $E_4$ represents bridging ligands which can be independently selected, E' is E or NZ, r is zero, −1, −2 or −3, and Z is oxygen or sulfur;

wherein the dopant of Formula (II) is selected from hexacoordination complexes which form deep electron traps in silver chloride grains by providing an incorporated molecular entity having a lowest unoccupied molecular orbital which is at least 0.5 eV below the conduction band of the silver chloride grains, where (i) less than 60% of the deep electron traps empty within 2000 seconds at 300 K after being filled and (ii) between 15–60% of the deep electron traps empty within 12,000 seconds at 300 K after being filled.

In a second aspect, this invention is directed towards a photographic recording element comprising a support and at least one light sensitive silver halide emulsion layer comprising silver halide grains as described above.

In another aspect, this invention is directed to an electronic printing method which comprises subjecting a radiation sensitive silver halide emulsion layer of a recording element to actinic radiation of at least $10^{-4}$ ergs/cm$^2$ for up to 100 $\mu$seconds duration in a pixel-by-pixel mode, wherein the silver halide emulsion layer is comprised of silver halide grains as described above.

It has been discovered that significantly improved latent image keeping performance can be obtained for optical and digital exposed elements which comprise silver halide grains in an emulsion layer doped with a dopant of Formula (I) and a dopant of Formula (II) as described above, while substantially maintaining other desired photographic parameters. In a preferred practical application, the advantages of the invention can be transformed into increased throughput of digital artifact-free color print images while exposing each pixel sequentially in synchronism with the digital data from an image processor.

DESCRIPTION OF PREFERRED EMBODIMENTS

In one embodiment, the present invention represents an improvement on the electronic printing method disclosed by Budz et al, cited above and here incorporated by reference. Specifically, this invention in one embodiment is directed to an electronic printing method which comprises subjecting a radiation sensitive silver halide emulsion layer of a recording element to actinic radiation of at least $10^{-4}$ ergs/cm$^2$ for up to 100 $\mu$seconds duration in a pixel-by-pixel mode. The present invention realizes an improvement in latent image keeping by modifying the radiation sensitive silver halide emulsion layer. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

Emulsions in accordance with the invention comprise high chloride silver halide grains doped with a shallow electron trapping hexacoordination complex dopant of Formula (I):

$$[RuL_6]^n \quad (I)$$

where n is zero, −1, −2, −3 or −4; and $L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complex of Formula (I) which includes six cyano ligands is specifically preferred.

Illustrations of specifically contemplated Formula (I) hexacoordination complexes for inclusion in the high chloride grains include ruthenium based dopants provided by Bell U.S. Pat. Nos. 5,474,888, 5,470,771 and 5,500,335, Olm et al U.S. Pat. No. 5,503,970 and Daubendiek et al U.S. Pat. Nos. 5,494,789 and 5,503,971, and Keevert et al U.S. Pat. No. 4,945,035, the disclosures of which are here incorporated by reference, as well as Murakami et al Japanese Patent Application Hei-2[1990]-249588, and *Research Disclosure* Item 36736, the disclosures of which are here incorporated by reference. Useful neutral and anionic organic ligands for dopant hexacoordination complexes are disclosed by Olm et al U.S. Pat. No. 5,360,712 and Kuromoto et al U.S. Pat. No. 5,462,849, the disclosures of which are here incorporated by reference.

The following are specific illustrations of Formula (I) dopants:

(I-1) $[Ru(CN)_6]^{-4}$
(I-2) $[RuCl(CN)_5]^{-4}$
(I-3) $[RuF_2(CN)_4]^{-4}$
(I-4) $[Ru(CN)_5(OCN)]^{-4}$
(I-5) $[Ru(CN)_5(N_3)]^{-4}$
(I-6) $[Ru(CO)_2(CN)_4]^{-2}$

When the Formula (I) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to Formula (II) dopants, otherwise described below.

Further in accordance with the invention, a contrast increasing hexacoordination complex dopant of Formula (II) is also located in the high chloride grains, where the dopant of Formula (II) is selected from hexacoordination complexes which form deep electron traps in silver chloride grains by providing an incorporated molecular entity having a lowest unoccupied molecular orbital which is at least 0.5 eV below the conduction band of the silver chloride grains, where (i) less than 60% of the deep electron traps empty within 2000 seconds at 300 K after being filled and (ii) between 15–60% (preferably between 25–60%) of the deep electron traps empty within 12,000 seconds at 300 K after being filled:

$$[Te_4(NZ)E']^r \quad \text{(II)}$$

wherein T is Os or Ru; E is a bridging ligand; E' is E or NZ; r is zero, −1, −2 or −3; and Z is oxygen or sulfur. The E ligands can take the form of any independently selected remaining bridging ligands, including aquo ligands, halide ligands (specifically, fluoride, chloride, bromide and iodide), cyano ligand, cyanate ligands, thiocyanate ligands, selenocyanate ligands, tellurocyanate ligands, and azide ligands, subject to the above stated electron trap emptying requirements. Cyano and halide ligands are generally preferred, and hexacoordinated transition metal complexes of Formula (II) which include 5 halide or cyano ligands are specifically preferred.

In general, the mechanism by which complexes of Formula (II) act as contrast increasing deep electron trapping dopants can be explained as follows. When doped into AgCl grains, the hexacoordination complex substitutes for an $(AgCl_6)^{5-}$ lattice unit. To reestablish charge neutrality in the grain, it is necessary to generate an appropriate number of additional lattice defects (e.g., 3 where r is −2), each with a charge of −1, for each incorporated complex. These defects are usually silver ion vacancies (=V) located in the grain interior or at the grain surface. In the grain interior, the vacancies can associate with the hexacoordination complex (i.e., be located at the nearest neighbor lattice positions), or be at more distant lattice sites. Where r=−2, e.g., the net effect is to set up a series of equilibria in the grain of the form:

$$[TE_4(NZ)E']^{-2}\cdot 3V \leftrightarrows [TE_4(NZ)E']^{-2}\cdot 2V+V$$

$$[TE_4(NZ)E']^{-2}\cdot 2V \leftrightarrows [TE_4(NZ)E']^{-2}\cdot 1V+V$$

$$[TE_4(NZ)E']^{-2}\cdot 1V \leftrightarrows [TE_4(NZ)E']^{-2}+V$$

The effects on deep electron trapping are (1) the electron-trapping cross-section increases as the positive site charge increases, and (2) the residence time for the trapped electron increases with the positive site charge. Here, $[TE_4(NZ)E']^{-2}\cdot 3V$ is neutral relative to the $(AgCl_6)^{5-}$ lattice unit, $[TE_4(NZ)E']^{-2}\cdot 2V$ has an effective site charge of +1, $[TE_4(NZ)E']^{-2}\cdot 1V$ has a charge of +2, and $[TE_4(NZ)E']^{-2}$ has a charge of +3. Thus, the deep electron trapping performance (and the effect on contrast) for such complexes follows the series:

$$[TE_4(NZ)E']^{-2}\cdot 3V < [TE_4(NZ)E']^{-2}\cdot 2V < [TE_4(NZ)E']^{-2}\cdot 1V < [TE_4(NZ)E']^{-2}$$

At effective Formula (II) doping levels (e.g., 1–100 molar parts per billion), most of the complexes will have fewer than 3 associated vacancies (i.e., the above equilibria will be strongly shifted to the right). The co-addition of excess shallow electron trapping ruthenium based dopants of Formula (I), however, introduces a high concentration of free silver ion vacancies (V). This drives the above Formula (II) dopant equilibria to the left, increasing the concentration of complexes have higher associated vacancies, and in effect, reducing the net trapped electron lifetime for the Formula (II) dopant complex. Where the effective net lifetime is sufficiently shortened, latent image keeping (LIK) performance can be detrimentally impacted. In accordance with the invention, dopants of Formula (II) are selected which themselves have net trapped electron lifetimes in silver chloride grains which are sufficiently long such that when they are employed in combination with shallow electron trapping ruthenium based dopants of Formula (I) in high chloride grain emulsions, LIK will not be significantly detrimentally impacted.

Complexes of Formula (II) for use in high chloride emulsions in accordance with the invention are evaluated with respect to electron trap emptying rates by the following method:

(a) The dopant to be evaluated is uniformly incorporated into a primitive 0.09 micrometer grain edge length cubic silver chloride emulsion at a nominal concentration of 1750 complexes/grain. Emulsion samples are degelled by washing with deionized water followed by centrifugation, and the isolated grains are then rinsed with acetone, dried under nitrogen at room temperature, and stored at 4 C.

(b) The degelled samples are exposed to 365 nm light at 160 K to fill the deep electron trapping centers. The concentration of filled dopant traps is determined by electron paramagnetic resonance spectroscopy (EPR) using the procedure and conditions described in R. S. Eachus, R. C. Baetzold, Th. D. Pawlik, O. G. Poluektov and J. Schmidt, Phys. Rev. B, vol. 59, 8560–8571 (1999).

(c) To determine the relative stabilities of the dopant-related deep electron traps, kinetic EPR measurements are made using a standard isochronal thermal pulse technique. Annealing is accomplished at 300 K for fixed periods of time (2000 and 12,000 seconds); EPR spectra are measured at 10 K to estimate trap concentrations.

Where the above test indicates that more than 60% of the deep electron traps empty within 2000 or 12000 seconds at 300 K after being filled, the dopant may not maintain an effective net trapped electron lifetime which is sufficient to avoid latent image keeping (LIK) problems in the presence of a shallow electron trapping ruthenium based codopant of Formula (I). Where less than 15% of the deep electron traps empty within 12,000 seconds at 300 K after being filled, emulsions containing such dopants may suffer from shelf-keeping or coating melt-hold problems due to trap filling by thermally generated electrons. In accordance with a preferred embodiment, a dopant of Formula (II) is employed wherein at least 25% (and up to 60%) of the deep electron traps empty within 12,000 seconds at 300 K after being filled to avoid shelf-keeping or coating melt-hold problems due to thermal filling.

The following are specific illustrations of Formula (II) compounds for use in accordance with the invention, and the percent decay of filled deep electron traps determined in accordance with the above described method. Note that the valance for the filled deep electron trapping center is changed relative to the dopant as incorporated due to the presence of the trapped electron.

| | Dopant | Filled deep electron trapping center | A = % decay after 2000 sec | B = % decay after 12000 sec |
|---|---|---|---|---|
| (II-1) | $[Ru(NO)Cl_5]^{-2}$ | $[Ru(NO)Cl_5]^{-3}$ | 27 | 27 |
| (II-2) | $[Os(NO)(CN)_5]^{-2}$ | $[Os(NO)(CN)_5]^{-3}$ | 25 | 32 |
| (II-3) | $[Ru(NO)(CN)_5]^{-2}$ | $[Ru(NO)(CN)_5]^{-3}$ | 15 | 15 |

The silver halide grains preferably contain from $10^{-8}$ to $10^{-3}$ mole (more preferably from $10^{-7}$ to $10^{-4}$ mole) of a dopant of Formula (I), and from $10^{-11}$ to $10^{-6}$ mole (more preferably from $10^{-10}$ to $10^{-7}$ mole) of a hexacoordination metal complex of Formula (II) per total mole of silver. The Formula (I) and Formula (II) dopants can each be distributed throughout the central portion of the grain, or can be added at one or more specific locations therein.

Dopant of Formula (I) is preferably introduced into the high chloride grains after at least 50 (most preferably 75 and optimally 80) percent of the silver has been precipitated for such grains, but before precipitation of the central portion of the grains has been completed. Preferably dopant of Formula (I) is introduced before 98 (most preferably 95 and optimally 90) percent of the silver has been precipitated. Stated in terms of the fully precipitated grain structure, the Formula (I) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The Formula (I) dopant can be distributed throughout the interior shell region delimited above or can be added as one or more bands within the interior shell region.

The use of codopants selected in accordance with the invention is particularly useful wherein the dopant of Formula (II) is located within the central portion of the grains in an interior region separated from a sub-surface shell region containing dopant of Formula (I) by less than ten percent of the total silver forming the grains, or within the central portion of the grains in a region which overlaps with the sub-surface shell region containing dopant of Formula (I). In a particular embodiment of the invention, e.g., the dopant of Formula (II) may be advantageously located in an interior region of the emulsion grains extending up to 75% of total grain precipitation, while the dopant of Formula (I) is in sub-surface shell region separated from the interior region containing the Formula (II) dopant by less than ten percent (preferably less than or equal to 5 percent) of the total silver forming the grains.

The silver halide grains of photographic emulsions in accordance with the invention may also include other dopants. Doping with iridium hexachloride complexes, e.g., is commonly performed to reduce reciprocity law failure in silver halide emulsions. According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure. Specific iridium dopants include those illustrated in high chloride emulsions by Bell U.S. Pat. Nos. 5,474,888, 5,470,771 and 5,500,335 and McIntyre et al U.S. Pat. No. 5,597,686. Specific combinations of iridium and other metal dopants may additionally be found in U.S. Pat. Nos. 4,828, 962, 5,153,110, 5,219,722, 5,227,286, and 5,229,263, and European Patent Applications EP 0 244 184, EP 0 405 938, EP 0 476 602, EP 0 488 601, EP 0 488 737, EP 0 513 748, and EP 0 514 675. In accordance with particularly preferred embodiments, an iridium coordination complex containing at least one thiazole or substituted thiazole ligand may be employed. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The iridium dopant preferably is a hexacoordination complex having ligands each of which are more electropositive than a cyano ligand. In a specifically preferred form the remaining non-thiazole or non-substituted-thiazole ligands of the iridium coordination complex dopants are halide ligands.

Iridium dopant is preferably introduced into the high chloride grains of each of the first and second portions after at least 50 (most preferably 85 and optimally 90) percent of the silver has been precipitated, but before precipitation of the central portion of the grains has been completed. Preferably iridium dopant is introduced before 99 (most preferably 97 and optimally 95) percent of the silver has been precipitated. Stated in terms of the fully precipitated grain structure, iridium dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The iridium dopant can be distributed throughout the interior shell region delimited above or can be added as one or more bands within the interior shell region. Iridium dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole. Specific illustrations of iridium dopants include the following:

(Ir-1) $[IrCl_5(thiazole)]^{-2}$
(Ir-2) $[IrCl_4(thiazole)_2]^{-1}$
(Ir-3) $[IrBr_5(thiazole)]^{-2}$
(Ir-4) $[IrBr_4(thiazole)_2]^{-1}$
(Ir-5) $[IrCl_5(5\text{-methylthiazole})]^{-2}$
(Ir-6) $[IrCl_4(5\text{-methylthiazole})_2]^{-1}$
(Ir-7) $[IrBr_5(5\text{-methylthiazole})]^{-2}$
(Ir-8) $[IrBr_4(5\text{-methylthiazole})_2]^{-1}$ As with dopants of Formula (I) and (II), when iridium dopants have a net negative charge, it is appreciated that they are associated with a counter ion when added to the reaction vessel during precipitation. Common counter ions known to be fully compatible with silver chloride precipitation, such as ammonium and alkali metal ions, are contemplated.

Emulsions demonstrating the advantages of the invention can be realized by modifying the precipitation of conventional high chloride silver halide grains having predominantly (>50%) {100} crystal faces to obtain grains incorporating the dopants of Formula (I) and Formula (II) as described above. The performance improvement described in accordance with the invention may be obtained for silver halide grains employing conventional gelatino-peptizer, as well as oxidized gelatin (e.g., gelatin having less than 30 micromoles of methionine per gram). Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver and iodide is limited to less than 1 mole percent based on silver.

In a widely used form high chloride grains are precipitated to form cubic grains, that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. Nos. 5,264,337 and 5,292,632, House et al U.S. Pat. No. 5,320,938, Brust et al U.S. Pat. No. 5,314,798 and Chang et al U.S. Pat. No. 5,413,904, the disclosures of which are here incorporated by reference.

Once high chloride grains having predominantly {100} crystal faces have been precipitated doped with a combination of dopants of Formula (I) and Formula (II) described above, chemical and spectral sensitization, followed by the addition of conventional addenda to adapt the emulsion for the imaging application of choice can take any convenient conventional form. The conventional features are further illustrated by *Research Disclosure,* Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
IX. Coating and physical property modifying addenda, and
X. Dye image formers and modifiers.

As pointed out by Bell, cited above, some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

In the simplest contemplated form a photographic element of the invention can consist of a single emulsion layer satisfying the emulsion description provided above coated on a conventional photographic support, such as those described in *Research Disclosure,* Item 38957, cited above, XVI. Supports. In one preferred form the support is a white reflective support, such as photographic paper support or a film support that contains or bears a coating of a reflective pigment. To permit a print image to be viewed using an illuminant placed behind the support, it is preferred to employ a white translucent support, such as a Duratrans™ or Duraclear™ support.

The photographic elements and printing methods of the invention can be used to form either silver or dye images in the recording element. In a simple form a single radiation sensitive emulsion layer unit is coated on the support. The elements can contain one or more high chloride silver halide emulsions satisfying the requirements of the invention. When a dye imaging forming compound, such as a dye-forming coupler, is present it can be in an emulsion layer or in a layer coated in contact with the emulsion layer. With a single emulsion layer unit a monochromatic image is obtained.

In a preferred embodiment the invention employs recording elements which are constructed to contain at least three silver halide emulsion layer units. A suitable multicolor, multilayer format for a recording element used in the invention is represented by Structure I.

| STRUCTURE 1 |
|---|
| Blue-sensitized |
| yellow dye image-forming silver halide emulsion unit |
| Interlayer |
| Green-sensitized |
| magenta dye image-forming silver halide emulsion unit |
| Interlayer |
| Red-sensitized |
| cyan dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are separated from each other by hydrophilic colloid interlayers containing an oxidized developing agent scavenger to prevent color contamination. Silver halide emulsions satisfying the requirements described above can be present in any one or combination of the emulsion layer units. Additional useful multicolor, multilayer formats for an element of the invention include Structures II–IV as described in U.S. Pat. No. 5,783,373 referenced above, which is incorporated by reference herein. Each of such structures in accordance with the invention would contain at least one silver halide emulsion comprised of high chloride grains having at least 50 percent of their surface area bounded by {100} crystal faces and containing dopants of Formula (I) and Formula (II) as described above. Preferably each of the emulsion layer units contain an emulsion satisfying these criteria.

Conventional features that can be incorporated into multilayer (and particularly multicolor) recording elements contemplated for use in the invention are illustrated by *Research Disclosure,* Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source need, of course, provide radiation in only one spectral region if the recording element is a monochrome element sensitive to only that region (color) of the electromagnetic spectrum. Suitable light emitting diodes and commercially available laser sources are described in the examples. Image-wise exposures at ambient, elevated or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18 and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100 $\mu$seconds, often up to 10 $\mu$seconds, and frequently up to only 0.5 $\mu$seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer,* Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1, the disclosures of which are hereby incorporated herein by reference.

Once imagewise exposed, the recording elements can be processed in any convenient conventional manner to obtain a viewable image. As demonstrated in the examples below, photographic elements in accordance with the invention demonstrate improved latent image keeping performance, decreasing the impact of delays in processing which may occur after imagewise exposure. Conventional processing is illustrated, e.g., by *Research Disclosure,* Item 38957, cited above:

XVIII. Chemical development systems

XIX. Development

XX. Desilvering, washing, rinsing and stabilizing

EXAMPLES

This invention can be better appreciated by reference to the following Examples. Emulsions A throughout J illustrate the preparation of radiation sensitive high chloride emulsions, both for comparison and inventive emulsions. Examples 1 and 2 illustrate that recording elements containing layers of emulsions in accordance with the invention exhibit characteristics which make them particularly useful in very fast optical printers and in electronic printing methods of the type described herein.

Emulsion Precipitations

Emulsion A: A reaction vessel contained 6.92 L of a solution that was 3.8% in regular gelatin and contained 1.71 g of a Pluronic antifoam agent. To this stirred solution at 46° C. 83.5 mL of 3.0 M NaCl was dumped, and soon after 28.3 mL of dithiaoctanediol solution was poured into the reactor. A half minute after addition of dithiaoctanediol solution, 104.5 mL of a 2.8 M $AgNO_3$ solution and 107.5 mL of 3.0 M NaCl were added simultaneously at 209 mL/min for 0.5 minute. The vAg set point was chosen equal to that observed in the reactor at this time. Then the 2.8 M silver nitrate solution and the 3.0 M sodium chloride solution were added simultaneously with a constant flow at 209 mL/min over 20.75 minutes. The emulsion was doped with 1.20 milligrams per silver mole of $K_2IrCl_5$ (5-Methyl-Thiazole) during to 90 to 95% of grain formation. The resulting silver chloride emulsion had a cubic shape that was 0.38 $\mu$m in edgelength. The emulsion was then washed using an ultrafiltration unit, and its final pH and pCl were adjusted to 5.6 and 1.8, respectively.

Emulsion B: This emulsion was precipitated exactly as Emulsion A, except that 16.54 milligrams per silver mole of $K_4Ru(CN)_6$ (dopant I-1) was added during precipitation during to 75 to 80% of grain formation.

Emulsion C: This emulsion was precipitated exactly as Emulsion B, except that 1.0 micrograms per silver mole of deep electron trapping dopant cesium pentachloronitrosylosmate ($Cs_2(II)Os[NO]Cl_5$) was added during precipitation during to 3.5 to 70% of grain formation. $[Os(NO)Cl_5]^{-2}$ complexes form deep electron traps in silver chloride grains where 68% of the deep electron traps empty within 2000 seconds at 300 K after being filled and 77% of the deep electron traps empty within 12,000 seconds at 300 K after being filled.

Emulsion D: This emulsion was precipitated exactly as Emulsion B, except that 1.5 micrograms per silver mole of $Cs_2(II)Os[NO]Cl_5$ was added during precipitation during to 3.5 to 70% of grain formation.

Emulsion E: This emulsion was precipitated exactly as Emulsion B, except that 2.25 micrograms per silver mole of $Cs_2(II)Os[NO]Cl_5$ was added during precipitation during to 3.5 to 70% of grain formation.

Emulsion F: This emulsion was precipitated exactly as Emulsion B, except that 3.5 micrograms per silver mole of $Cs_2(II)Os[NO]Cl_5$ was added during precipitation during to 3.5 to 70% of grain formation.

Emulsion G: This emulsion was precipitated exactly as Emulsion B, except that 5.0 micrograms per silver mole of $Cs_2(II)Os[NO]Cl_5$ was added during precipitation during to 3.5 to 70% of grain formation.

Emulsion H: This emulsion was precipitated exactly as Emulsion B, except that 1.50 micrograms per silver mole of $K_2Ru(NO)Cl_5$ (dopant II-1) was added during precipitation during to 3.5 to 70% of grain formation.

Emulsion I: This emulsion was precipitated exactly as Emulsion B, except that 3.0 micrograms per silver mole of $K_2Ru(NO)Cl_5$ was added during precipitation during to 3.5 to 70% of grain formation.

Emulsion J: This emulsion was precipitated exactly as Emulsion B, except that 6.0 micrograms per silver mole of $K_2Ru(NO)Cl_5$ was added during precipitation during to 3.5 to 70% of grain formation.

Sensitization of Emulsions

The emulsions were each optimally sensitized by the customary techniques using two basic sensitization schemes. The sequence of chemical sensitizers, spectral sensitizers, and antifoggants addition are the same for each finished emulsion. Both colloidal gold sulfide or gold(I) (as disclosed in U.S. Pat. No. 5,945,270) and hypo ($Na_2S_2O_3$) were used for chemical sensitization. Detailed procedures are described in the Examples below.

In red-sensitized emulsions the following red spectral sensitizing dye was used:

Spectral Sensitizing Dye A

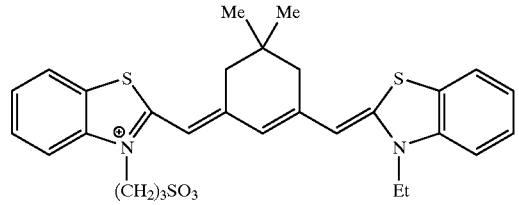

Just prior to coating on resin coated paper support red-sensitized emulsions were dual-mixed with cyan dye forming coupler A:

Coupler A:

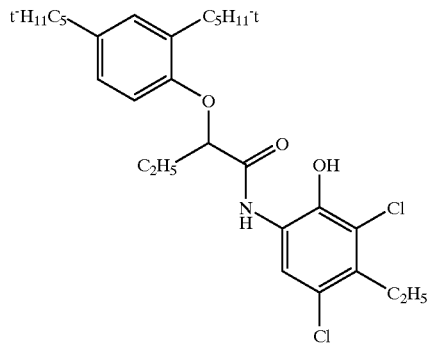

In green-sensitized emulsions the following green spectral sensitizing dye was used:

Spectral Sensitizing Dye B

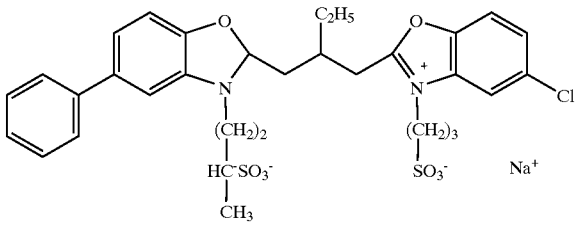

Just prior to coating on resin coated paper support green-sensitized emulsions were dual-mixed with magenta dye forming coupler B:

Coupler B:

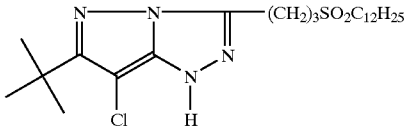

The emulsions were coated at 194 mg silver per square meter on resign-coated paper support. The coatings were overcoated with gelatin layer and the entire coating was hardened with bis(vinlsulfonylmethyl)ether.

Photographic Comparisons

Coatings were exposed with Toshiba TOLD 9140™ exposure apparatus at 691 nm (red sensitized emulsions), and 532 nm (green sensitized emulsions), a resolution of 176.8 pixels/cm, a pixel pitch of 42.47 $\mu$m, and the exposure time of 1 microsecond per pixel. These exposures will be referred to as "Digital Sensitivity" in the following Examples.

All coatings were processed in Kodak™ Ektacolor RA-4. Relative laser SPEED values were reported at density level equal to 0.80, TOE values were reported as the density at 0.80 density level minus 0.3 log E, and SHOULDER values were reported as the density at density level equal to 0.80 plus 0.3 log E. Speed is reported as relative log speed. In relative log speed units a speed difference of 30, for example, is a difference of 0.30 log E, where E is exposure in lux-seconds. To provide a measurement of Latent Image Keeping performance, processing for samples of each of the optical and laser exposed coatings was also delayed (2 minutes and 2 and 24 hours vs. 20 seconds for the laser exposures), and density changes at SPEED and SPEED+0.2 log E noted.

Example 1

This example compares effects of codoping deep electron trapping dopant $Cs_2(II)Os[NO]Cl_5$ or $K_2Ru(NO)Cl_5$ with shallow electron dopant $K_4Ru(CN)_6$ on speed, toe, and shoulder sensitometric performance, as well as short, medium and long term latent image keeping (LIK). In each case, silver chloride cubic emulsions sensitized for red color record were used. The sensitization details are as follows:

Part 1.1: A portion of silver chloride Emulsion A was optimally sensitized by the addition of p-glutaramidophenyl disulfide (GDPD) followed by addition of the optimum amount of hypo followed by addition of gold(I). The emulsion was then heated to 65° C. and held at this temperature for 30 minutes with subsequent addition of 1-(3-acetamidophenyl)-5-mercaptotetrazole followed by addition of bromide. Then the emulsion was cooled to 40° C. and Spectral Sensitizing dye A was added.

Part 1.2: A portion of silver chloride Emulsion B was sensitized exactly as in Part 1.1.

Part 1.3: A portion of silver chloride Emulsion C was sensitized exactly as in Part 1.1.

Part 1.4: A portion of silver chloride Emulsion E was sensitized exactly as in Part 1.1.

Part 1.5: A portion of silver chloride Emulsion F was sensitized exactly as in Part 1.1.

Part 1.6: A portion of silver chloride Emulsion G was sensitized exactly as in Part 1.1.

Part 1.7: A portion of silver chloride Emulsion H was sensitized exactly as in Part 1.1.

Part 1.8: A portion of silver chloride Emulsion I was sensitized exactly as in Part 1.1.

Part 1.9: A portion of silver chloride Emulsion J was sensitized exactly as in Part 1.1.

Sensitometric data are summarized in Table 1.

TABLE 1

| | Dopants | | | | | | Laser Exposure Latent Image Keeping | | | | | |
|---|---|---|---|---|---|---|---|---|---|---|---|---|
| | Comp | | | | | | 20 sec to 2 min | | 20 sec to 2 hr | | 20 sec to 24 hr | |
| | II-1 ($\mu$g[1]/ | DET[2] ($\mu$g[3]/ | I-1 (mg[4]/ | Laser Exposure Sensitometry | | | ΔD @ SPEED | | ΔD @ SPEED | | ΔD @ SPEED | |
| No. | Ag mole) | Ag mole | Ag mole) | SPEED | TOE | SHLDR | ΔD @ SPEED | +0.2 logE | ΔD @ SPEED | +0.2 logE | ΔD @ SPEED | +0.2 logE |
| 1.1 | 0 | 0 | 0 | 135 | 0.420 | 1.883 | 0.0048 | 0.0071 | 0.0054 | 0.0184 | 0.0236 | 0.0476 |
| 1.2 | 0 | 0 | 16.54 | 143 | 0.415 | 1.951 | 0.0075 | 0.0094 | 0.0143 | 0.0287 | 0.0238 | 0.0476 |
| 1.3 | 0 | 1.0 | 16.54 | 135 | 0.380 | 1.989 | 0.0095 | 0.0143 | 0.0381 | 0.0476 | 0.0857 | 0.1143 |
| 1.4 | 0 | 2.25 | 16.54 | 130 | 0.322 | 2.118 | 0.0333 | 0.0524 | 0.0809 | 0.0999 | 0.1524 | 0.1953 |
| 1.5 | 0 | 3.5 | 16.54 | 126 | 0.297 | 2.159 | 0.0381 | 0.0667 | 0.1048 | 0.1238 | 0.2619 | 0.2952 |
| 1.6 | 0 | 5.0 | 16.54 | 122 | 0.238 | 2.256 | | | | | | |
| 1.7 | 1.5 | 0 | 16.54 | 138 | 0.342 | 2.033 | 0 | 0 | 0 | 0 | 0 | 0 |

TABLE 1-continued

| | Dopants | | | | | | Laser Exposure Latent Image Keeping | | | | | |
|---|---|---|---|---|---|---|---|---|---|---|---|---|
| | Comp | | | | | | 20 sec to 2 min | | 20 sec to 2 hr | | 20 sec to 24 hr | |
| | II-1 ($\mu$g[1]/ | DET[2] ($\mu$g[3]/ | I-1 (mg[4]/ | Laser Exposure Sensitometry | | | | ΔD @ SPEED | | ΔD @ SPEED | | ΔD @ SPEED |
| No. | Ag mole) | Ag mole | Ag mole) | SPEED | TOE | SHLDR | ΔD @ SPEED | +0.2 logE | ΔD @ SPEED | +0.2 logE | ΔD @ SPEED | +0.2 logE |
| 1.8 | 3.0 | 0 | 16.54 | 132 | 0.294 | 2.125 | 0 | 0 | 0 | −0.0024 | 0 | −0.0047 |
| 1.9 | 6.0 | 0 | 16.54 | 113 | 0.199 | 2.322 | 0.002 | 0.0024 | −0.0041 | −0.0082 | −0.0140 | −0.0238 |

[1]Potassium salt;
[2]$[Os(NO)Cl_5]^{-2}$;
[3]Cesium salt;
[4]Potassium salt

The presence of deep electron trapping dopant complex $[Os(NO)Cl_5]^{-2}$, which does not meet the requirements of the invention, in the emulsion in combination with shallow electron trapping dopant I-1 results in narrower dynamic range (improved shoulder contrast) which lowers emulsion fringing, but with a significant laser LIK penalty. The same advantageous features of narrowed dynamic range and improved shoulder contrast is obtained by doping the emulsion with dopant II-1 $[Ru(NO)Cl_5]^{-2}$ in accordance with the invention in combination with dopant I-1, without producing any significant LIK response in spite of the relatively high $[Ru(NO)Cl_5]^{2-}$ levels used.

Example 2

This example compares effects of codoping deep electron trapping dopant $Cs_2(II)Os[NO]Cl_5$ or $K_2Ru(NO)Cl_5$ with shallow electron dopant $K_4Ru(CN)_6$ on speed, toe, and shoulder sensitometric performance, as well as short, medium and long term latent image keeping (LIK). In each case, silver chloride cubic emulsions sensitized for green color record were used. The sensitization details are as follows:

Part 2.1: A portion of silver chloride Emulsion A was optimally sensitized by the addition of p-glutaramidophenyl disulfide (GDPD) followed by addition of the optimum amount of Spectral Sensitizing dye B, followed by addition of gold-sulfide. The emulsion was then heated to 55° C. and held at this temperature for 35 minutes with subsequent addition of bromide followed by addition of 1-(3-acetamidophenyl)-5-mercaptotetrazole.

Part 2.2: A portion of silver chloride Emulsion D was sensitized exactly as in Part 2.1.

Part 2.3: A portion of silver chloride Emulsion H was sensitized exactly as in Part 2.1.

Part 2.4: A portion of silver chloride Emulsion I was sensitized exactly as in Part 2.1.

Part 2.5: A portion of silver chloride Emulsion J was sensitized exactly as in Part 2.1.

Sensitometric data are summarized in Table 2.

TABLE 2

| | Dopants | | | | | | Laser Exposure Latent Image Keeping | | | | | |
|---|---|---|---|---|---|---|---|---|---|---|---|---|
| | Comp | | | | | | 20 sec to 2 min | | 20 sec to 2 hr | | 20 sec to 24 hr | |
| | II-1 ($\mu$g[1]/ | DET[2] ($\mu$g[3]/ | I-1 (mg[4]/ | Laser Exposure Sensitometry | | | | ΔD @ SPEED | | ΔD @ SPEED | | ΔD @ SPEED |
| No. | Ag mole) | Ag mole | Ag mole) | SPEED | TOE | SHLDR | ΔD @ SPEED | +0.2 logE | ΔD @ SPEED | +0.2 logE | ΔD @ SPEED | +0.2 logE |
| 2.1 | 0 | 0 | 0 | 81 | 0.598 | 1.464 | 0.0107 | 0.0321 | 0.050 | 0.1428 | 0.0524 | 0.1571 |
| 2.2 | 0 | 1.5 | 16.54 | 125 | 0.384 | 1.744 | 0.0112 | 0.0501 | 0.0857 | 0.2071 | 0.1286 | 0.2572 |
| 2.3 | 1.5 | 0 | 16.54 | 123 | 0.424 | 1.678 | 0.0102 | 0.0428 | 0.0510 | 0.1471 | 0.0643 | 0.1642 |
| 2.4 | 3.0 | 0 | 16.54 | 109 | 0.346 | 1.816 | 0.0016 | 0.0437 | 0.0514 | 0.1436 | 0.0685 | 0.1684 |
| 2.5 | 6.0 | 0 | 16.54 | 94 | 0.270 | 1.930 | 0.0108 | 0.0357 | 0.0512 | 0.1357 | 0.0651 | 0.1428 |

[1]Potassium salt;
[2]$[Os(NO)Cl_5]^{-2}$;
[3]Cesium salt;
[4]Potassium salt

The presence of deep electron trapping dopant complex $[Os(NO)Cl_5]^{-2}$, which does not meet the requirements of the invention, in the emulsion in combination with shallow electron trapping dopant I-1 results in narrower dynamic range (improved shoulder contrast) which lowers emulsion fringing, but with a significant laser LIK penalty. The same advantageous features of narrowed dynamic range and improved shoulder contrast is obtained by doping the emulsion with dopant II-1 $[Ru(NO)Cl_5]^{-2}$ in accordance with the invention in combination with dopant I-1, while substantially reducing LIK response in spite of the relatively high $[Ru(NO)Cl_5]^{2-}$ levels used.

It is specifically contemplated that emulsions in accordance with the invention may be sensitized with red, green, and blue sensitizing dyes and be incorporated in a color paper format as described in Example 4 of U.S. Pat. No. 5,783,373, incorporated by reference above.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains (a) containing greater than 50 mole percent chloride, based on silver, (b) having greater than 50 percent of their surface area provided by {100} crystal faces, and (c) having a central portion accounting for up to 99 percent of total silver and containing a first dopant of Formula (I) and a second dopant of Formula (II):

$$[RuL_6]^n \quad \text{(I)}$$

wherein n is zero, −1, −2, −3 or −4, and $L_6$ represents bridging ligands which can be independently selected, provided that at least four of the ligands are anionic ligands, and at least one of the ligands is a cyano ligand or a ligand more electronegative than a cyano ligand;

$$[TE_4(NZ)E']^r \quad \text{(II)}$$

wherein

T is Os or Ru, $E_4$ represents bridging ligands which can be independently selected, E' is E or NZ, r is zero, −1, −2 or −3, and Z is oxygen or sulfur;

wherein the dopant of Formula (II) is selected from hexacoordination complexes which form deep electron traps in silver chloride grains by providing an incorporated molecular entity having a lowest unoccupied molecular orbital which is at least 0.5 eV below the conduction band of the silver chloride grains, where (i) less than 60% of the deep electron traps empty within 2000 seconds at 300 K after being filled and (ii) between 15–60% of the deep electron traps empty within 12,000 seconds at 300 K after being filled.

2. An emulsion according to claim 1 wherein the silver halide grains contain from $10^{-8}$ to $10^{-3}$ mole of a hexacoordination metal complex of Formula (I) per mole of silver.

3. An emulsion according to claim 2 wherein the dopant of Formula (I) is present in a concentration of from $10^{-7}$ to $10^{-4}$ mole per silver mole.

4. An emulsion according to claim 1 wherein the silver halide grains contain from $10^{-11}$ to $10^{-6}$ mole of a hexacoordination metal complex of Formula (II) per mole of silver.

5. An emulsion according to claim 1 wherein the dopant of Formula (I) is present in a concentration of from $10^{-8}$ to $10^{-3}$ mole per mole of silver and is located within the central portion of grains in a sub-surface shell region surrounding at least 50 percent of the total silver forming the grains, and the dopant of Formula (II) is present in a concentration of from $10^{-11}$ to $10^{-6}$ mole per mole of silver and is located within the central portion of the grains in an interior region separated from the sub-surface shell region containing dopant of Formula (I) by less than ten percent of the total silver forming the grains, or within the central portion of the grains in a region which overlaps with the sub-surface shell region containing dopant of Formula (I).

6. An emulsion according to claim 1 wherein between 25–60% of the deep electron traps formed by the dopant of Formula (II) empty within 12,000 seconds after being filled at 300 K.

7. An emulsion according to claim 1 wherein each of the bridging ligands of the dopant of Formula (I) are at least as electronegative as cyano ligands.

8. An emulsion according to claim 1 wherein T represents an osmium ion.

9. An emulsion according to claim 1 wherein T represents a ruthenium ion.

10. An emulsion according to claim 1 wherein the dopant of Formula (I) is $[Ru(CN)_6]^{-4}$ and the dopant of Formula (II) is $[Ru(NO)(CN)_5]^{-2}$, $[Ru(NO)Cl_5]^{-2}$, or $[Os(NO)(CN)_5]^{-2}$.

11. An emulsion according to claim 10 wherein the dopant of Formula (II) is $[Ru(NO)Cl_5]^{-2}$ or $[Os(NO)(CN)_5]^{-2}$.

12. An emulsion according to claim 10 wherein the dopant of Formula (II) is $[Ru(NO)Cl_5]^{-2}$.

13. An emulsion according to claim 10 wherein the dopant of Formula (II) is $[Os(NO)(CN)_5]^{-2}$.

14. An emulsion according to claim 1 wherein the silver halide grains contain at least 70 mole percent chloride, based on silver.

15. An emulsion according to claim 1 wherein the silver halide grains contain less than 5 mole percent iodide, based on silver.

16. A photographic recording element comprising a support bearing at least one radiation-sensitive silver halide emulsion layer comprising an emulsion according to claim 1.

17. An electronic printing method which comprises subjecting the radiation sensitive silver halide emulsion layer of a recording element according to claim 16 to actinic radiation of at least $10^{-4}$ ergs/cm$^2$ for up to 100 $\mu$seconds duration in a pixel-by-pixel mode.

18. A method according to claim 17 wherein the pixels are exposed to actinic radiation of about $10^{-3}$ ergs/cm$^2$ to $10^2$ ergs/cm$^2$.

19. A method according to claim 17 wherein the exposure is up to 10 $\mu$seconds.

20. A method according to claim 17 wherein the source of actinic radiation is a light emitting diode.

21. A method according to claim 17 wherein the source of actinic radiation is a laser.

* * * * *